United States Patent [19]

Garavuso

[11] Patent Number: 4,478,404

[45] Date of Patent: Oct. 23, 1984

[54] PNEUMATIC EXTENSION BOTTOM STACKING

[75] Inventor: Gerald M. Garavuso, Macedon, N.Y.

[73] Assignee: Xerox Corporation, Stamford, Conn.

[21] Appl. No.: 490,071

[22] Filed: Apr. 29, 1983

[51] Int. Cl.[3] ..... B65H 31/08

[52] U.S. Cl. ..... 271/212; 271/3.1; 271/147; 271/196

[58] Field of Search ..... 271/212, 194, 195, 147, 271/3.1, 196

[56] References Cited

U.S. PATENT DOCUMENTS

| | | | |
|---|---|---|---|
| 3,396,966 | 8/1968 | Solheim | 271/86 |
| 3,947,018 | 3/1976 | Stange | 271/99 |
| 3,971,554 | 7/1976 | Stange | 271/212 X |
| 4,162,067 | 7/1979 | Horak et al. | 271/177 |
| 4,189,140 | 2/1980 | Swanson | 271/212 |
| 4,384,782 | 5/1983 | Aquaviva | 271/212 X |
| 4,413,901 | 11/1983 | Kollar | 271/3.1 X |

FOREIGN PATENT DOCUMENTS

| | | | |
|---|---|---|---|
| 0020973 | 1/1981 | European Pat. Off. | 27/46 |

*Primary Examiner*—Richard A. Schacher
*Attorney, Agent, or Firm*—William A. Henry, II

[57] ABSTRACT

Apparatus for inserting sheets at the bottom of a stack of sheets including a levitation pocket and a positive air pressure source to provide an air cushion between the stack tray and the bottom sheet in the stack. Drive belts feed sheets under the stack in cooperation with a vacuum source that deflects the sheets against the belts and into a groove until the sheets reach the positive pressure source where they are pushed upward against the bottom of the stack.

9 Claims, 3 Drawing Figures

PNEUMATIC EXTENSION BOTTOM STACKING

This invention relates to recirculating automatic document feed devices for copying machines, and more particularly, to an improved bottom stacker for use in such devices.

The advantage of a recirculating automatic document feeder (RADF) is well known in the art. For example, one such advantage is the ability to recirculate a multi-sheet original document, making one copy per circulation, such that the copy output comprises a single stack of many collated copy sets without the necessity of providing an output multi-bin collator. This pre-collation copying is sometimes accomplished by feeding the multi-sheets of the original document from the top of the stack and insert each sheet after copying in the bottom of the stack.

Some of the problems encountered with RADFs of the top feed/bottom stack variety include the tendancy for sheets to fold as they reenter the bottom of the stack due to curl induced into the sheets by transport rollers, wrinkle from misalignment of sheets as they reenter the bottom of the stack and the inability of the RADFs to accomodate extremely lightweight sheets.

Various solutions to bottom stacking problems have been exhibited. For example, U.S. Pat. No. 3,947,018 discloses the use of air flotation and a vacuum roll or belt assembly to minimize drag forces on a sheet being inserted or removed from the bottom of a stack of sheets. In U.S. Pat. No. 3,396,966 a sheet stacking apparatus is shown that includes a guide that prevents previously stacked sheets from blocking the entry of a sheet being placed at the bottom of a stack of sheets and to prevent the sheet being introduced into the stack from damaging a sheet previously placed at the bottom of the stack. Air is injected into the stack of sheets in order to separate them.

An air assisted document stacking apparatus is disclosed in U.S. Pat. No. 4,162,067 that employs an elongated drive belt to entrain and move items into a stacker pocket with the pocket having means for applying positive air pressure thereto so as to move incoming items out of the path of following items entering the pocket and for applying negative pressure to the pocket for closely stacking items together in the pocket by removing residual air from between the items.

Another known sheet stacker apparatus is in U.S. Pat. No. 4,189,140 which shows the use of vacuum belts to hold sheets in shingled form while in transit to a stacking station.

Notwithstanding the solutions in the above-mentioned patents, problems still arise since a stack of sheets must be lifted while a single sheet is inserted under the stack which in some applications could include approximately 100 sheets.

Accordingly, in accordance with one aspect of the present invention, a top feed/bottom stacker is disclosed that levitates a stack of sheets by air flow while a sheet is inserted beneath the stack by a "smart" vacuum which holds the sheet to be inserted beneath the stack down until it is completely in place under the stack where the sheet is then automatically lifted up against the stack.

Further features and advantages of the present invention pertain to the particular apparatus whereby the above-noted aspects of the invention are obtained. Accordingly, the invention will be better understood by reference to the following description, and to the drawings forming a part thereof, which are approximately to scale, wherein.

Figure 1:
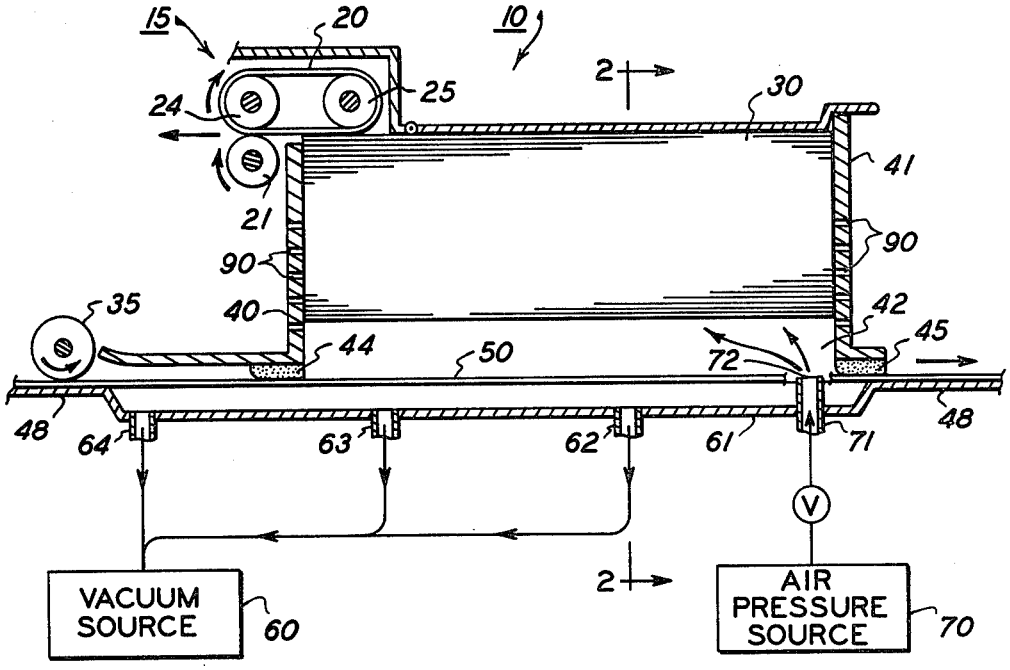
FIG. 1 is a partial elevational schematic view of the top feed/bottom stacker apparatus of the present invention.

While the present invention will be described in a preferred embodiment, it will be understood that it is not intended to limit the invention to that embodiment. On the contrary, it is intended to cover all alternatives, modifications and equivalents as may be included within the spirit and scope of the invention as defined by the appended claims.

The apparatus that encompasses the present invention will now be described in detail with reference to the figures where like reference numerals will be employed throughout to designate identical elements. Although the apparatus for bottom stacking sheets is particularly well adapted for use as a part of a recirculating automatic document handler, it should be evident from the following discussion that it is equally well suited for use in any environment where bottom stacking of sheets is required and not necessarily limited in application to the particular embodiment shown. For example, the bottom stacking feature of the present invention could be used in a copy sheet tray or duplex tray.

Referring now to FIG. 1, the pneumatic extension bottom stacker and top feeder of the present invention 10 includes a conventional retard roll sheet feeding system 15 that has a belt 20 entrained around spaced apart rollers 24 and 25. While a friction retard feeder is disclosed herein, it should be understood that any top sheet feeder would be appropriate, especially vacuum corrugated feeders. In FIG. 1, belt 20 along with retard roller 21 forms a nip that separates and inhibit multifeeds from sheet stack 30. The stack of sheets is sealably enclosed above plate 48 by end walls 40 and 41 and side walls 42 and 43 (not shown). Seals 44 and 45 prevent any loss of air along the bottom of the side and end walls. Sheet transport belts 50 forward sheets toward stack 30 while the sheets are held on the belts by conventional means, such as, rollers until the sheets approach end wall 40 where sheet tacking to belts 50 is accomplished by vacuum source 60 that is connected to a groove 61 that runs along a major portion of tray bottom enclosure 48.

During the time of transport of sheets toward the stack, the sheets 31 in the stack are levitated by an air flow from positive pressure source 70 through pipes 71 to allow incoming sheets to be inserted beneath the stack by a "smart" vacuum which holds the incoming sheets down until they are completely in place where they are automatically lifted up to the bottom of the stack to be recirculated in pre-collated order for further processing.

Figure 2:
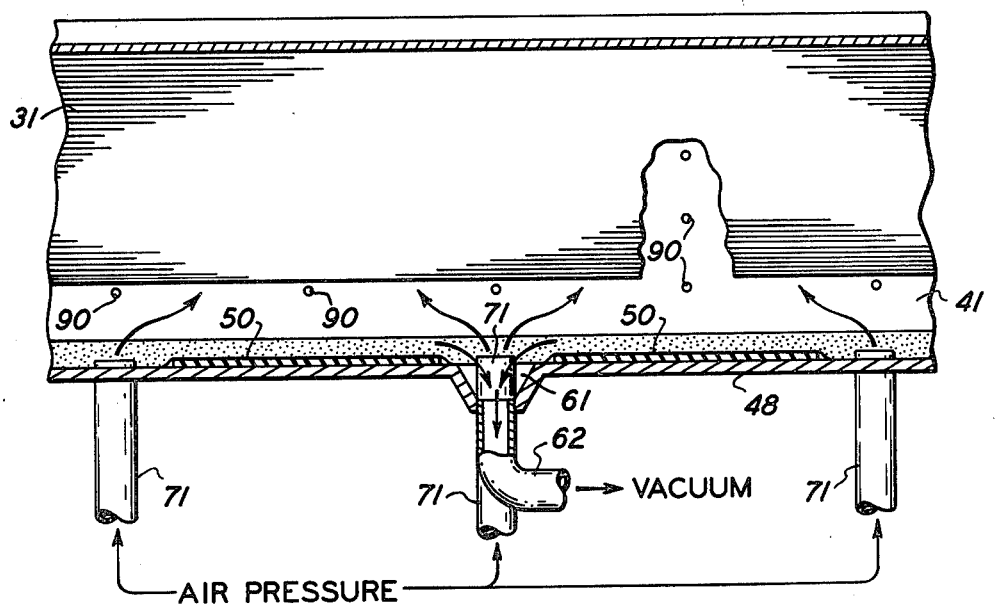
FIG. 2 is an exploded partial end view of the apparatus of FIG. 1 along section 2—2.

In the initial condition of the present apparatus as shown in FIG. 1, the positive air pressure port 72 delivers a higher flow into the vacuum grooves 61 and levitation pocket 42 than the negative ports can remove. The resulting delta, therefore, provides the pocket pressure required to support the stack. As a sheet enters the levitation pocket, a vacuum is developed in groove 61 below the sheet by a single negative port 62 or a series of negative ports 62, 63 and 64. These additional vacuum ports may be necessary to maintain sheet control against belts 50 as shown in FIG. 2. The sheet continues to extend the vacuum as it slides under the stack. By letting the sheet sag into the groove, a better vacuum seal will be achieved. When the sheet reaches back stop or end wall 41, positive pressure port 72 is covered and the pressure below the sheet is suddenly increased lifting the sheet up against the bottom of the stack. This may require a minimum sheet speed of the apparatus.

The levitation pressure through conduits 71 can be used for stack elevation by allowing gradually increasing leaks to occur through holes 90 in end walls 40 and 41 as the bottom of the stack is elevated. This will create a high pressure below a heavy (thick) stack and lower pressure below a light (thin) stack. Therefore, the top of the stack will be maintained at a near constant level permitting sets of various sizes to be handled with equal ease.

Figure 3:
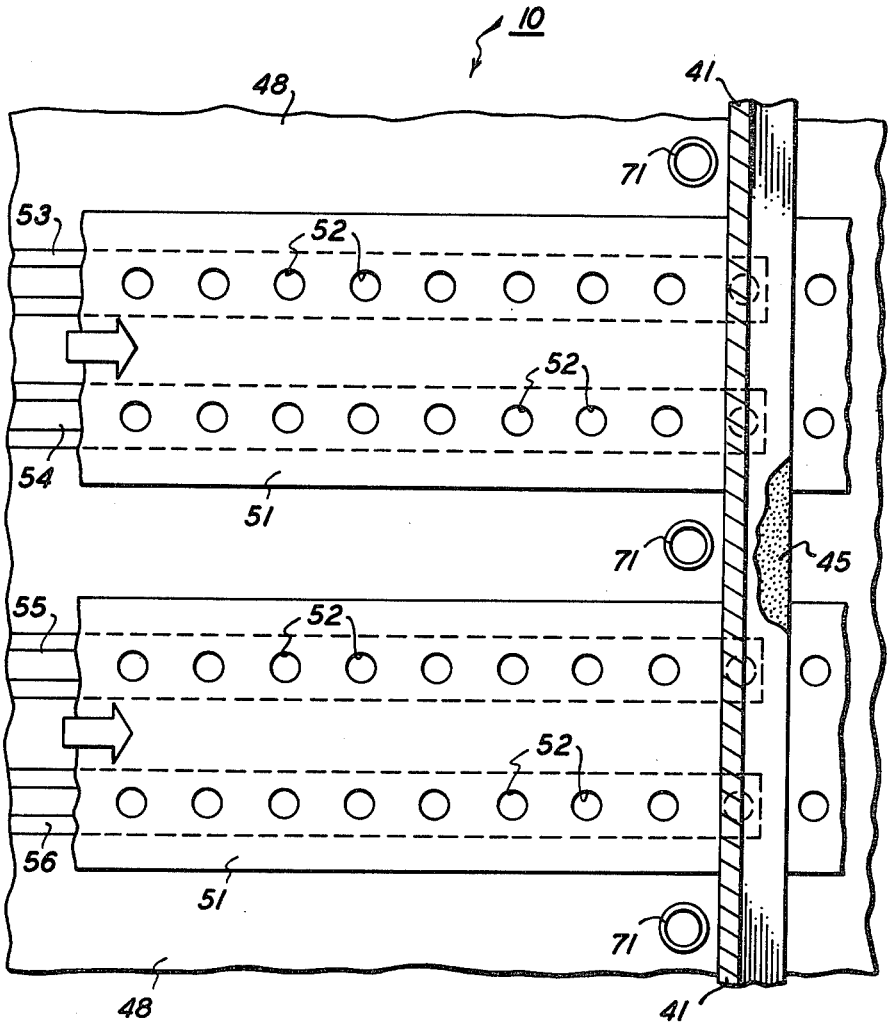
FIG. 3 is a plan view of an alternative embodiment of the present invention.

An alternative embodiment of the present invention is shown in FIG. 3 where a sheet is feed in the direction of the arrows into the bottom stacker 10 by being captured by vacuum belts 51 and advanced against registration wall 41. Seal 45 prevents the loss of air along the bottom of the registration wall. The vacuum belts are perforated at areas 52 above vacuum channels 53, 54, 55 and 56 that are connected to vacuum source 60. The vacuum channels or grooves extend beyond registration wall 41 so that the front end of the sheet will not curl up and fold against the bottom of sheet stack 30 due to positive air pressure from pressure source 70 through pipes 71.

As a sheet is conveyed on plate 48 past drive roller 35, it is captured by a vacuum applied through holes 52 in belts 51. Meanwhile, positive pressure through pipes 71 levitate stack 30 above plate 48 allowing the incoming sheet to be inserted beneath the stack. The sheet is held against the belts until it is past pipes 71 where air from the pipes will pass along the bottom of the sheet and fill the vacuum channels and subsequently lift the sheet up against the bottom sheet in the stack as a succeeding sheet enters the stacker.

It should now be understood that a device has been disclosed that enables top sheet feeders to be used in recirculating document handling, duplex and automatic document feed applications. The device and system of the present invention also enables more cost effective finishing configurations. Further, it should be understood that this system is also applicable to the stacking and removal of vertically stacked sheets. The system includes a pneumatic extension bottom stacker that has a levitiation pocket fed by positive pressure and vacuum ports in separate locations to provide a "smart" vacuum system to hold a new sheet down until it is completely in place, then automatically lifts it up against the bottom of a stack and thus provides a unique and very reliable solution to an important problem of bottom stacking.

What is claimed is:

1. A bottom sheet stacking apparatus, comprising:

a sheet tray adapted to receive a stack of sheets, said tray including front, rear and side wall means which form an air tight seal around the stack of sheets, said rear wall serving as a registration means for incoming sheets into the tray;

feed belt means for forwarding sheets into said tray;

positive air pressure means located at the rear of the sheet stack for levitating the sheet stack by air flow while the sheets are inserted beneath the stack;

groove means in the bottom of said tray, said groove means being adapted to extend a major portion of the distance between said front wall and said rear wall means; and vacuum means connected to a vacuum port located immediately before said front wall and within said groove means, said vacuum means being adapted to hold incoming sheets on said belt means until the sheets are completely in registration against said rear wall and since the incoming sheets will then cover said positive pressure means they are automatically levitated above said belt means.

2. A bottom sheet stacking apparatus, comprising:

a sheet tray adapted to receive a stack of sheets, said tray including front, rear and side wall means which form an air tight seal around the stack of sheets;

feed means for forwarding sheets into said tray;

positive air pressure means for levitating the sheet stack by air flow while a sheet is inserted beneath the stack;

groove means recessed in the bottom of said tray, said groove means being adapted to extend a major portion of the distance between said front wall and rear wall means; and vacuum means connected to said groove means such that said vacuum means holds an incoming sheet on said feed means until the sheet is lifted away from the feed means by said positive pressure means.

3. The apparatus of claim 2, wherein said front and rear wall means includes pressure relief means.

4. The apparatus of claim 3, wherein said vacuum means includes a plurality of vacuum ports connected to a negative pressure source.

5. The bottom sheet stacking apparatus of claim 2, wherein incoming sheets are deflected into said groove means while being forwarded beneath the sheet stack.

6. The apparatus of claim 2, wherein said groove means extends forward of said front wall means.

7. A bottom sheet stacking apparatus, comprising:

a sheet tray adapted to receive a stack of sheets, said tray including front, rear and side wall means which form an air tight seal around the stack of sheets, said rear wall serving as a registration means for incoming sheets into the tray;

a plurality of feed belts for forwarding sheets into said tray;

positive air pressure means located at the rear of the sheet stack for levitating the sheet stack by air flow while sheets are inserted beneath the stack;

groove means recessed adjacent said feed belts, said groove means being adapted to extend a major portion of the distance between said front and rear wall means; and vacuum means connected to a vacuum port located immediately before said front wall and within said groove means, whereby said vacuum means holds incoming sheets on said belts until the sheets are completely in registration against said rear wall means and since the incoming sheets will then cover said positive pressure means they are automatically levitated above said belts.

8. A bottom sheet stacking apparatus, comprising:

an enclosed sheet tray adapted to receive sheets individually to form a stack;

a plurality of perforated feed belts for forwarding sheets into said tray;

positive air pressure means located at the front of the sheet stack for levitating the sheet stack by air flow while sheets are inserted beneath the stack;

groove means recessed beneath said perforated feed belts, said groove means being adapted to extend a major portion of the sheet stack; and vacuum means connected to said perforated feed belts through groove means, whereby said vacuum means holds incoming sheets on said perforated feed belts until the sheets are completely beneath the sheet stack and since the incoming sheets will then cover said positive pressure means they are automatically levitated above said perforated feed belts and against the bottom of the sheet stack.

9. The bottom sheet stacking apparatus of claim 8, wherein said groove means originates before reaching the sheet stack and extends beyond the sheet stack.

* * * * *